US008704166B2

(12) United States Patent
Nishida

(10) Patent No.: US 8,704,166 B2
(45) Date of Patent: Apr. 22, 2014

(54) ION TRAP TYPE MASS SPECTROMETER AND MASS SPECTROMETRY

(75) Inventor: Tetsuya Nishida, Hitachinaka (JP)

(73) Assignee: Hitachi High-Technologies Corporation, Tokyo (JP)

( * ) Notice: Subject to any disclaimer, the term of this patent is extended or adjusted under 35 U.S.C. 154(b) by 0 days.

(21) Appl. No.: 13/812,125

(22) PCT Filed: Jul. 25, 2011

(86) PCT No.: PCT/JP2011/066796

§ 371 (c)(1),
(2), (4) Date: Apr. 5, 2013

(87) PCT Pub. No.: WO2012/014828

PCT Pub. Date: Feb. 2, 2012

(65) Prior Publication Data

US 2013/0181124 A1 Jul. 18, 2013

(30) Foreign Application Priority Data

Jul. 27, 2010 (JP) ..... 2010-167684

(51) Int. Cl.
*H01J 49/00* (2006.01)

(52) U.S. Cl.
USPC ..... 250/282; 250/281; 250/283; 702/19; 702/23; 707/999.001

(58) Field of Classification Search
USPC ..... 250/281, 282, 283; 702/19, 23; 707/999.001
See application file for complete search history.

(56) References Cited

U.S. PATENT DOCUMENTS

| | | | | |
|---|---|---|---|---|
| 5,679,950 | A | 10/1997 | Baba et al. | |
| 5,783,824 | A | 7/1998 | Baba et al. | |
| 6,720,554 | B2 * | 4/2004 | Hager | 250/282 |
| 7,989,764 | B2 | 8/2011 | Yasuda et al. | |
| 8,417,466 | B2 * | 4/2013 | Yamaguchi | 702/23 |
| 2001/0007349 | A1 | 7/2001 | Nagai | |
| 2008/0054173 | A1 | 3/2008 | Yasuda et al. | |
| 2008/0111068 | A1 * | 5/2008 | Zabrouskov | 250/282 |
| 2009/0230298 | A1 * | 9/2009 | Yamaguchi | 250/281 |
| 2010/0312489 | A1 * | 12/2010 | Yamaguchi | 702/23 |

FOREIGN PATENT DOCUMENTS

| | | | |
|---|---|---|---|
| JP | 1-239753 | A | 9/1989 |
| JP | 8-273588 | A | 10/1996 |
| JP | 2000-299083 | A | 10/2000 |

(Continued)

*Primary Examiner* — Michael Logie
(74) *Attorney, Agent, or Firm* — McDermott Will & Emery LLP

(57) ABSTRACT

Provide is an ion trap mass spectrometer which is configured to gain an MS spectrum of only fragment data in an MS/MS analysis, thereby makes it possible to perform the analysis in a short period. For this purpose, the device is comprised of: an ionization unit configured to ionize a sample which has been separated into respective components; an ion trap unit configured to trap ions ionized by ionization unit in an electric field and eject the ions in accordance with the respective masses of the ions; a detection unit configured to detect the ions ejected from the ion trap unit; and a processing unit configured to generate an MS spectrum (mass spectrum) on the basis of data detected in the detection unit. The processing unit further configured to gain an MS spectrum of only fragment data of a target ion from a difference between an MS spectrum gained in an MS analysis made before and/or after an MS/MS analysis and an MS spectrum gained in the MS/MS analysis.

2 Claims, 3 Drawing Sheets

(56) References Cited

FOREIGN PATENT DOCUMENTS

| | | | |
|---|---|---|---|
| JP | 2001-249114 | A | 9/2001 |
| JP | 2008-058281 | A | 3/2008 |
| JP | 2008-096353 | A | 4/2008 |
| WO | WO-2008/116283 | A1 | 10/2008 |
| WO | 2009-054026 | A1 | 4/2009 |

* cited by examiner

ION TRAP TYPE MASS SPECTROMETER AND MASS SPECTROMETRY

CROSS-REFERENCE TO RELATED APPLICATION

This application is a national stage entry of PCT/JP2011/066796 filed Jul. 25, 2011 which claims priority from Japanese Patent Application No. 2010-167684 filed Jul. 27, 2010. The contents of each are hereby incorporated by reference.

TECHNICAL FIELD

The present invention relates to an ion trap type mass spectrometer which has an ion trap unit and is capable of making measurement by tandem mass spectrometric analysis and a mass spectrometry.

BACKGROUND ART

Mass spectrometers are each a device of ionizing a sample molecule, separating its resultant ions through an electric field or a magnetic field in accordance with their mass-to-charge ratios, and then, measuring the quantity of separated specific ions as a current by a detector. That is: a sample is separated into individual components respectively through a separation column of a liquid chromatograph and then introduced into an ionization unit; in an ionization unit of amass spectrometer, molecules of the sample is ionized, and the ionized ions are introduced into the mass spectrometer; the introduced ions are trapped in an electric field made of its ion trap unit; the trapped ions are ejected selectively from the ion trap unit in accordance with their mass-to-charge ratios or ejected together from the ion trap unit; ant then the ejected ions are detected in its detection unit. A graph in which the mass-to-charge ratio of each of the ions detected in this unit is taken as a transverse axis and its signal intensity is taken as a vertical axis is called an MS spectrum (mass spectrum).

Each mass spectrum has data as to a specific mass-to-charge ratio of its corresponding ion in a sample molecule and signal strength thereof, and structural information on the sample component can be gained from such data. When carrying out an analysis of peptides, reading out information as to the peptides contained in a sample from peak data represented in an MS spectrum, and then carrying out the analysis by using a computer and an exclusive data base or some other. In order to raise precision of the analysis, it is necessary to obtain a larger number of structural information from the MS spectrum.

However, in a case that components in a sample have complex structures, when, in spite of the fact that the components are different from each other in structure, they have an equal mass-to-charge-ratio, the difference therebetween may not be sufficiently discerned only by information obtained from their MS spectra. In such a case, executed is measurement according to tandem mass spectrometry (hereinafter referred to as MS/MS analysis) (see, for example, Patent Document 1).

In MS/MS analysis, the method is comprised of: trapping ions into an ion trap; excluding non-target ions therein by applying energy such as high-frequency voltage; subjecting selectively left ions to dissociation by making them collide with neutral molecules such as rare gas molecules thereby to break bonds of the molecular ion; and measuring resultant dissociated ions (called as fragment ions). This dissociation, which is generated by the collision with the neutral molecules, is called as collision induced dissociation (abbreviated to CID), thereby obtained is an MS/MS spectrum. An analyzing operation of repeating sequential operations for MS/MS analysis is called as MS2, MS3 or the like in accordance with the number of times of the repeating. From peculiar fragment ions generated by this operation, a larger number of structural information can be obtained about the sample.

When ions to be dissociated in execution of MS/MS analysis are beforehand known, an analyzer can set the ions as conditions to be used in the measurement. However, in a protein analysis or some other analysis, it is unclear what ions are contained in a sample in many cases. In such a case, the analyzer initially subjects the sample to an MS analysis, subsequently determines, from an MS spectrum gained therein, ions to be dissociated under certain conditions, and then subjects the determined ion to an MS/MS analysis. By repeating this operation, structural information can be gained about many ions to be measured.

In a liquid chromatograph, a sample is separated into individual components through its separation column in accordance with the degree of affinity thereof for the separation column, and thereby, the components are successively eluted out from the separation column. These components are each introduced into a mass spectrometer to gain an MS spectrum. A graph where signal intensities at a specific mass-to-charge ratio are lined with a time series is referred to as a mass chromatogram.

When examining what quantity of a detected component is contained in a sample, a measurement is carried out beforehand about a reference sample in which a concentration of this kind of component is already known, and then a calibration curve is prepared on a basis of the area or height of a peak of the component on a mass chromatogram obtained in the measurement to carry out a quantitative calculation of the component. In recent years, mass spectrometers have been required to have a function of using peaks of fragments subjected to MS/MS analysis to carry out such a quantitative determination.

In order to carry out an MS analysis for gaining an MS spectrum, the following operation is made in an ion trap. Ions introduced into amass spectrometer are further introduced into an ion trap unit, and then trapped by an electric field made in the ion trap unit (accumulation). This electric field is changed to eject the ions from the ion trap unit (ejection), and then the ions are detected in a detector. In order to conduct an MS/MS analysis, the following operation is carried out in the ion trap unit.

Ions introduced in the mass spectrometer are introduced into an ion trap unit, and trapped by an electric field generated in the ion trap unit (accumulation). Non-target ions are excluded from the ions trapped in the ion trap unit (isolation), and then energy such as high-frequency voltage, corresponding to the selectively left ion therein, is applied to cause impact induced dissociation (CID). Subsequently, the electric field in the ion trap unit is changed to eject the ion from the ion trap unit, and then the ion is detected in the detector (ejection).

In MSn analysis in which n thereof represents the number of times of MS, the isolation and the CID are performed plural times between the accumulation and the ejection, thereby, target ions can be detected.

In MS/MS analysis, there is time required for isolations and CIDs, so that a period necessary for gaining an MS spectrum becomes longer than in MS analysis. In the meantime, the width of any peak in a chromatogram is fixed depending on the performance of the separation column. Thus, the number of MS spectra that can be gained in this period is limited.

Fragment ions of an MS spectrum that are gained as a result of an MS/MS analysis, each has a smaller signal intensity than strength of originally selected ion. When structural information is gained from the MS spectrum, a given threshold for separating signals from noises is set in order to avoid effects of the noises and others. Thereby, the structural information is gained from any peak equal or larger (in value) than the threshold. In such a way, an MS spectrum having a sufficient strength can be gained.

In order to identify a fragment pattern precisely from an MS spectrum, it is desired to subject the concerned component to MS/MS analysis at plural times to render its ion strength information sufficient information. Therefore, it is required to carry out MS/MS analysis at plural times during a component per one elutes out from the separation column. When two or more components elute out in the same time band from the column, it is required to subject these components to respective MS/MS analyses while the components elute out therefrom.

As described above, MS/MS analysis is required to be carried out in a short period. However, in the MS/MS analysis, operations of isolations and CIDs are since necessary, more time is required to gain a MS spectrum of a component per one therein than in MS analysis. Furthermore, recent liquid chromatographs have been promoted in operation-speed to improve performance of their separation column for separating a sample into individual components, and reduce a consumed volume of a solvent of each chromatograph.

In such a high-speed liquid chromatograph, a period when each component elutes out has become shorter, so that a further restriction is imposed onto the number of times of MS/MS analysis that can be carried out by a mass spectrometer in the period when the component per one elutes out. Accordingly, the mass spectrometer has been desired to make shorter a period required for gaining each MS/MS spectrum and gain MS spectra as many as possible.

When dissociation is performed to make an MS/MS analysis in an analysis of a protein or some other, it is unclear what ions are contained in a sample. Therefore, when performing the dissociation, it is performed by the following method of: first of all, making an MS analysis initially; determining, from an MS spectrum gained therein, an ion to be dissociated under some condition; and subjecting the determined ion to an MS/MS analysis. By repeating this method, structural information can be gained about many ions to be measured.

In the method, the MS analysis and the MS/MS analysis are different from each other in period necessary for analysis. For this reason, these analyses do not become identical with each other in sampling-period of the chromatogram, so that the same components having the same concentration are varied in peak area. The matter that the same components having the same concentration are different from each other in peak area results in a problem when a quantitative calculation is made.

CITATION LIST

Patent Documents

Patent literature 1: JP 2008-58281 A1

SUMMARY OF THE INVENTION

Problem to be Solved

An object of the present invention is to provide an ion trap mass spectrometer that gains an MS spectrum as to only fragment data of a target ion in an MS/MS analysis, thereby makes it possible to perform the analysis in a short period.

Solution to the Problems

In order to solve the object, the present invention is configured to gain an MS spectrum of only fragment data of the target ion from a difference between an MS spectrum gained in an MS analysis made before and after an MS/MS analysis and an MS spectrum in the MS/MS analysis.

Advantageous Effects of the Invention

According to the invention, an MS/MS spectrum can be gained through the same process as used in an MS analysis, which process includes neither any isolation step nor any collision-dissociating step in an ordinary MS/MS analysis. Thus, anion trap mass spectrometer can be obtained by gaining an MS spectrum of only fragment data of a target ion, thereby making it possible to make an analysis in a short period.

MODE FOR CARRYING OUT THE INVENTION

An embodiment of the present invention will be described with reference to the drawings.

Embodiment

Figure 1:
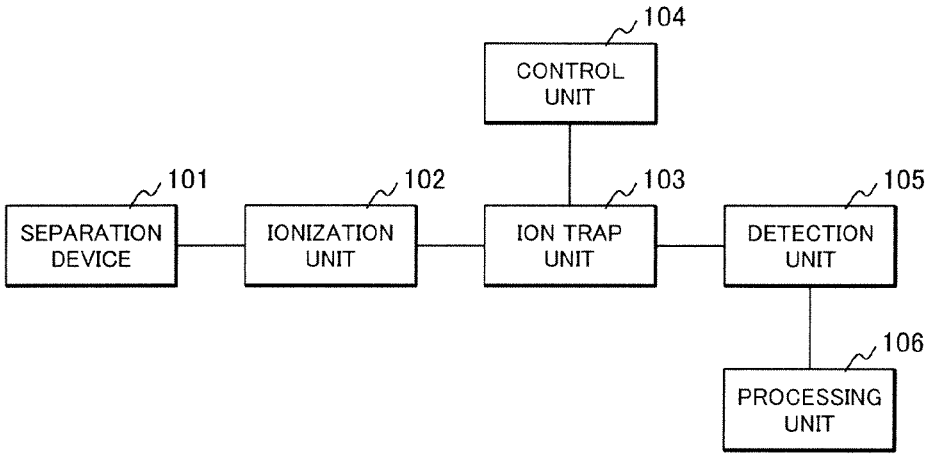
FIG. 1 is a structural view illustrating a schematic structure of an ion trap mass spectrometer of an embodiment of the invention.

FIG. 1 is a structural view illustrating a schematic structure of an ion trap mass spectrometer. A sample to be analyzed is separated into individual components different from each other in nature by a separation device 101 such as a separation column of a liquid chromatograph. The components are each ionized in an ionization unit 102, and then introduced into an ion trap unit 103 of the mass spectrometer. The introduced ions are trapped in an electric field of the ion trap unit 103. A control unit 104 causes energy for trapping the ions into the ion trap unit 103 to be applied in a form of a voltage to the unit 103. By controlling this energy, the ions can be ejected from the ion trap unit 103. The ejected ions are detected in a detection unit 105. Data on the detected ions are processed into desired data in a processing unit 106.

In the present structure, one or more analysis units, which separate the ions from each other or concentrate the ions, may be set up before and/or behind the ion trap unit.

Figure 2:
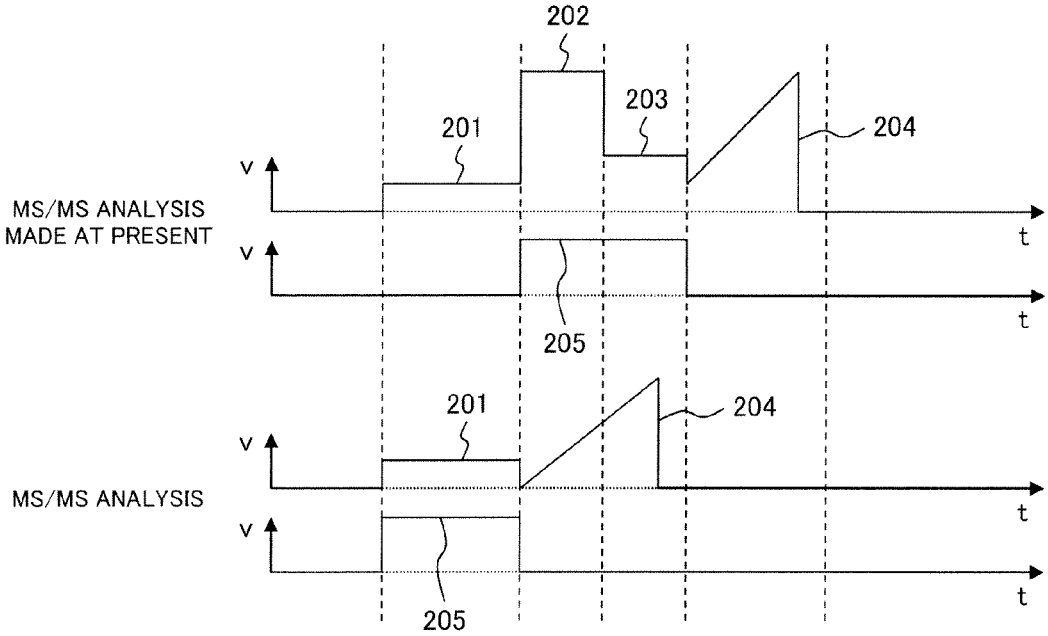
FIG. 2 is a timing chart showing each analysis controlling timing in an ion trap unit thereof.

FIG. 2 is a timing chart showing each analysis controlling timing carried out in the ion trap unit 103. Transverse axes thereof each represent time t, and vertical axes each represent voltage v. The vertical axes thereof represent, from top to bottom: a voltage applied to trap ions into an electrode or a Q pole of a trap unit and a voltage applied to eject the ions from the trap unit in the case of a conventional analysis; and a voltage applied to trap ions thereinto and a voltage applied to eject the ions therefrom in the present invention's embodiment. In the conventional MS/MS analysis, an accumulation (section 201) is carried out to introduce ions into the ion trap unit 103, and then an isolation (section 202) is carried out to eject ions other than a target ion from the introduced ions. An collision dissociation for the target ion is then carried out by an CID (section 203) in the ion trap unit, and the resultant ions are ejected from the ion trap unit 103 in an ejection (section 204). In the timing of the isolation (section 202) and the CID (section 203), energy is applied thereto (section 205) to eject ions other than the target ion from the ion trap unit 103 and dissociate the target ion.

Incidentally, when the mass spectrometer has a structure in which an analysis unit is set up behind the ion trap unit, it's all right to, in the ejection (section 204), clamp a voltage applied for trapping ions and apply another voltage for ejecting ions to the trap unit.

On the other hand, according MS/MS analysis in the present invention's embodiment, such energy (section 205) is applied in the accumulation (section 201) where ions introduced into the ion trap unit 103 thereby to dissociate the target ion of the sample, after that, the dissociated ions are subjected to ejection (section 204) to be ejected from the ion trap. The energy (section 205) for the dissociation is applied at the same time when the accumulation (section 201) is carried out. However, the energy may be applied at any timing of the accumulation section.

Figure 3:
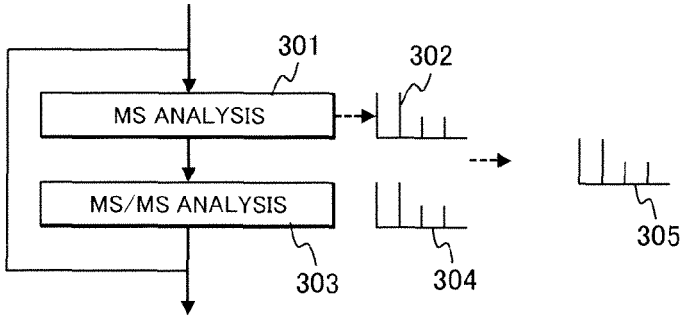
FIG. 3 is a flowchart showing steps for gaining a fragment spectrum in the embodiment.

FIG. 3 is a flowchart showing steps for gaining a fragment spectrum. In order to determine initially the target ion to be subjected to MS/MS, an analyzer makes an MS analysis (step 301) to gain an MS spectrum 302. From the MS spectrum 302 gained in this step, the analyzer selects and determines a target peak ion under designated conditions. Next, the analyzer makes an MS/MS analysis for the determined target peak ion (step 303). An MS spectrum 304 gained in this step includes peak data in the MS and peak data in the MS/MS analysis. Subsequently, by subtracting the MS spectrum 302 from the spectrum 304, it can results in an MS spectrum 305 including only fragment data. From then on, this flow is repeated, thereby making it possible to gain MS spectra of the MS/MS analyses successively.

The above-mentioned explains about an example of subtracting the MS spectrum of the MS analysis made just previously from the MS spectrum of the MS/MS analysis. However, when a change in the quantity of the ions is large relatively in a continuous operation of gaining MS spectra, a large accidental error may be involved only by a simple subtraction (as described above) since some MS spectrum is large in change from an MS spectrum gained in an MS analysis made just previously. In such a case, by making a prediction about the MS spectrum of the MS analysis to be subtracted from the MS spectrum of the MS/MS analysis corresponding to the fragment-data-containing MS spectrum, from MS spectra gained before and after the fragment-data-containing MS spectrum, and by subtracting the predicted MS spectrum from the fragment-data-containing MS spectrum, an MS spectrum of only the fragment data can be gained.

Figure 4:
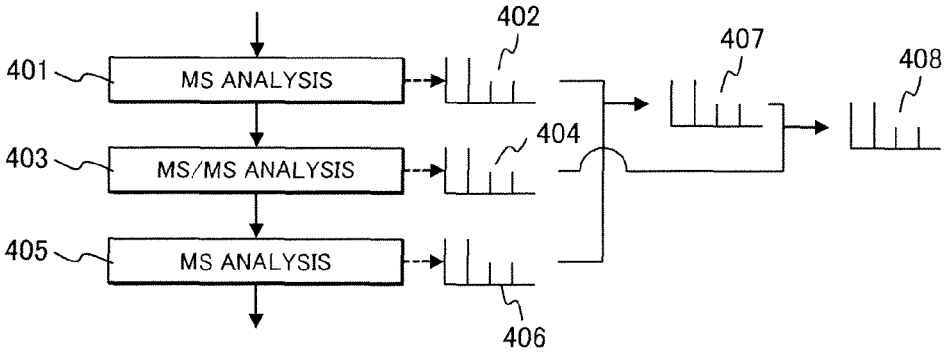
FIG. 4 is a flowchart showing steps for gaining a fragment spectrum in the embodiment.

FIG. 4 is a flowchart showing steps for gaining such a fragment spectrum. Initially, in order to determine a target ion to be subjected to MS/MS, an analyzer makes an MS analysis (step 401) to gain an MS spectrum 402. From the MS spectrum 402 gained in this step, the analyzer determines a target peak under designated conditions. Next, the analyzer makes an MS/MS analysis for the determined target (step 403). An MS spectrum 404 gained in this step includes peak data in the MS and peak data in the MS/MS. Furthermore, in order to select a next target ion, the analyzer makes an MS analysis (step 405) to gain an MS spectrum 406. Next, through a computer in the processing unit 106, an MS spectrum 407 is predicted from the MS spectrum 402 and the MS spectrum 406, and then the MS spectrum 407 is subtracted from the MS/MS spectrum 404. This process makes it possible to gain an MS spectrum 408 containing only fragment data. Subsequently, this process is repeated to make it possible to gain MS spectra of the MS/MS analyses successively.

Figure 5:
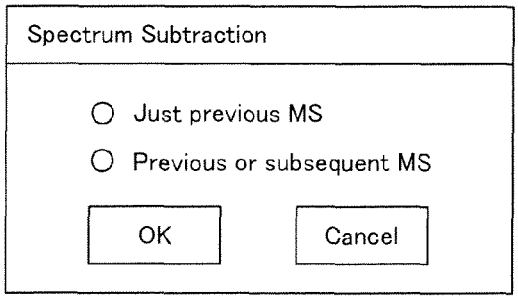
FIG. 5 is a screen view illustrating an example of a screen displayed in a display of a processing unit in the embodiment.

FIG. 5 is a screen view illustrating an example of a screen displayed in a display of the processing unit 106. In the above-mentioned MS spectrum gaining method described with reference to each of FIGS. 3 and 4, it is decided in accordance with the state of a change in the ions whether such subtracted is the MS spectrum of the MS analysis made just previous to the MS/MS analysis or the MS spectrum predicted from spectra of the MS analyses carried out before and after the MS/MS analysis. Thus, it is conceivable that the analyzer switches therebetween in accordance with the situation. In the screen illustrated in FIG. 5, the analyzer can select whether such subtracted is the MS spectrum of the MS analysis made just previous to the MS/MS analysis or the MS spectrum predicted from spectra of the MS analyses carried out before and after the MS/MS analysis.

Figure 6:
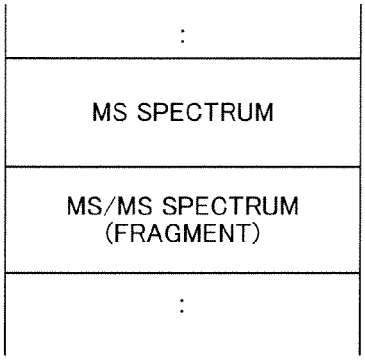
FIG. 6 is a conceptual view showing a partial structure of a data file held in the processing unit.
Figure 7:
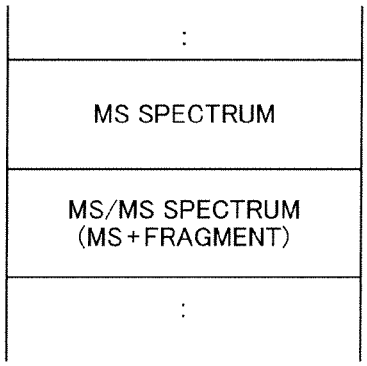
FIG. 7 is a conceptual view showing a partial structure of a data file held in the processing unit.

FIGS. 6 and 7 are each a conceptual view showing a partial structure of a data file held in the processing unit 106. MS/MS spectrum analysis is classified into a case where the analysis is made at the same time when data are gained, and a case where the analysis is made after data are gained. FIG. 6 shows a structure of a data file in a case where an MS/MS spectrum analysis is made at the same time when data are gained. In this case, the gained data file stores therein only fragment data as the MS/MS spectrum. FIG. 7 shows a structure of a data file in a case where an MS/MS spectrum analysis is made after data are gained. In this case, the gained data file stores therein a spectrum in which the MS spectrum and the fragment spectrum are present in a mixture form; and the subtraction is done between the data and the MS spectrum of the MS analysis made just previous to the MS/MS analysis, or between the data and the MS spectrum predicted from spectra of the MS analyses carried out before and after the MS/MS analysis In this way, the MS spectrum 408 illustrated in FIG. 4 can be gained.

Figure 8:
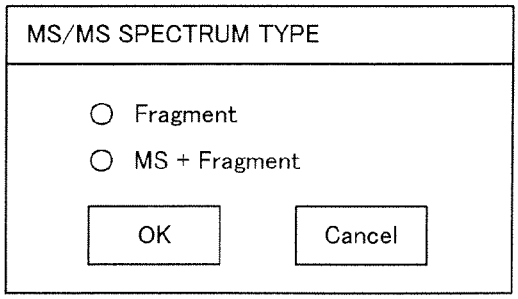
FIG. 8 is a screen view illustrating an example of a screen displayed in the display of the processing unit.

FIG. 8 is a screen view illustrating an example of a screen displayed in the display of the processing unit 106. The analyzer can select whether doing an MS/MS spectrum analysis as illustrated in any one of FIGS. 6 and 7 at the same time when data are gained, or after data are gained.

As described hereinbefore, according to the embodiment of the present invention, an MS/MS spectrum can be gained through the same process as used in an MS analysis, which process includes neither any isolation step nor any collision-dissociating step in the conventional MS/MS analysis. Thus, an ion trap mass spectrometer can be obtained by gaining an MS spectrum of only fragment data of a target ion, thereby making it possible to make an analysis in a short period.

REFERENCE SIGN LIST

101 separation device
102 ionization unit
103 ion trap unit

104 control unit
105 detection unit
106 processing unit

The invention claimed is:

1. A mass analysis method of ionizing a sample which has been separated into respective components, introducing the resultant ions into an ion trap unit to be trapped in an electric field, and detecting the ions ejected in accordance with the respective masses of the ions to generate an MS spectrum (mass spectrum), comprising the steps of:

generating a first MS spectrum of the sample, carrying out an MS/MS analysis of a target peak ion selected from the first MS spectrum to generate a second MS spectrum, carrying out an MS/MS analysis of the target peak ion gained in the second MS spectrum to generate a third MS spectrum, generating a fourth MS spectrum from the first MS spectrum and the third MS spectrum, and generating, from a difference between the fourth spectrum and the second MS spectrum, a fifth MS spectrum containing only fragment information.

2. An ion trap mass spectrometer, comprising:

an ionization unit configured to ionize a sample which has been separated into respective components;

an ion trap unit configured to trap ions ionized by ionization unit in an electric field and eject the ions in accordance with the respective masses of the ions;

a detection unit configured to detect the ions ejected from the ion trap unit; and a processing unit configured to generate an MS spectrum (mass spectrum) on the basis of data detected in the detection unit, wherein the processing unit further configured to generate a first MS spectrum of the sample, carry out an MS/MS analysis of a target peak ion selected in the first MS spectrum to generate a second MS spectrum, carry out an MS analysis of the target peak ion in the second MS spectrum to generate a third MS spectrum, generate a fourth MS spectrum from the first MS spectrum and the third MS spectrum, and generate from a difference between the fourth spectrum and the second MS spectrum, a fifth MS spectrum containing only fragment information.

* * * * *